US007922896B2

(12) United States Patent
Newman et al.

(10) Patent No.: US 7,922,896 B2
(45) Date of Patent: Apr. 12, 2011

(54) METHOD FOR REDUCING FOULING OF COKER FURNACES

(75) Inventors: Bruce A. Newman, Ponca City, OK (US); Keith D. Alexander, Ponca City, OK (US); Gary C. Hughes, Ponca City, OK (US); James R. Roth, Rockwell, TX (US)

(73) Assignee: ConocoPhillips Company, Houston, TX (US)

( * ) Notice: Subject to any disclaimer, the term of this patent is extended or adjusted under 35 U.S.C. 154(b) by 459 days.

(21) Appl. No.: 12/110,385

(22) Filed: Apr. 28, 2008

(65) Prior Publication Data

US 2009/0266742 A1 Oct. 29, 2009

(51) Int. Cl.
*C10G 9/14* (2006.01)

(52) U.S. Cl. ..... 208/131; 208/48 R; 208/48 AA

(58) Field of Classification Search ..... 208/48 AA, 208/48 R, 131

See application file for complete search history.

(56) References Cited

U.S. PATENT DOCUMENTS

| | | | |
|---|---|---|---|
| 2,717,865 | A | 9/1955 | Kimberlin, Jr. et al. |
| 4,213,846 | A | 7/1980 | Sooter et al. |
| 4,455,219 | A | 6/1984 | Janssen et al. |
| 4,518,487 | A | 5/1985 | Graf et al. |
| 4,549,934 | A | 10/1985 | Graf et al. |
| 4,661,241 | A | 4/1987 | Dabkowski et al. |
| 4,720,338 | A | 1/1988 | Newman et al. |
| 5,350,503 | A | 9/1994 | Freymeyer et al. |
| 6,270,656 | B1 | 8/2001 | Gibson et al. |

FOREIGN PATENT DOCUMENTS

| | | |
|---|---|---|
| WO | WO 98/36036 A1 | 8/1998 |
| WO | WO 99/64540 A1 | 12/1999 |
| WO | WO 01/53813 A1 | 7/2001 |

OTHER PUBLICATIONS

Zaporin, V.P. et al. (2007). Chemistry and Technology of Fuels and Oils, 43(4), 326-329.*

Fitzgerald, M.E. et al. (1970). Applied Spectroscopy, 24(1), 106-114.*

Motaghi, M. et al. (2010). KBR Technology, pp. 15-18. Available at: http://www.kbr.com/Newsroom/Publications/Articles/Anode-Grade-Coke-from-Traditional-Crudes.pdf.*

Vasilenko, G.V. et al. (1984). Chemistry and Technology of Fuels and Oils, 19(7), 354-256.*

* cited by examiner

*Primary Examiner* — Robert J Hill, Jr.
*Assistant Examiner* — Brian McCaig

(57) ABSTRACT

A method for reducing furnace fouling in a delayed coking process comprising (a) supplying at least one feed to a delayed coking unit comprised of coker furnace, at least two coke drums and a coker fractionator, (b) increasing the aromaticity of the feed to produce a modified stream by combining with the feed upstream of the coker furnace at least one added stream selected from the group consisting of an aromatic gas oil, a hydrotreated aromatic gas oil and combinations thereof, (c) introducing the modified feed stream into the coker furnace, d) heating the modified feed stream to a coking temperature in the coker furnace to produce a heated modified stream, and e) transferring the heated modified stream from the coker furnace to a coke drum.

20 Claims, 10 Drawing Sheets

Delta C-13 aromaticity, % = .555 - .02045 * Hydrogen uptake, SCFB; R^2 = .9875

Coking Propensity Results

METHOD FOR REDUCING FOULING OF COKER FURNACES

BACKGROUND OF THE INVENTION

This invention relates to methods for reducing furnace fouling in delayed coking processes, and more particularly in delayed coking processes in which the coker feedstock has a high propensity for furnace fouling.

Delayed coking is a non-catalytic thermal cracking process for treating various low value residual ("resid") streams from petroleum refinery processes. The treatment enhances the value of such streams by converting them to lower boiling cracked products. In a conventional delayed coking process, as described for example in U.S. Pat. No. 4,455,219, feedstock is introduced to a fractionator to produce an overhead stream, a bottoms stream and at least one intermediate stream. The fractionator bottoms stream including recycle material is heated to coking temperature in a coker furnace. The heated feed is then transferred to a coke drum maintained at coking conditions of temperature and pressure where the feed decomposes to form coke and volatile components. The volatile components are recovered and returned to the fractionator. When the coke drum is full of solid coke, the feed is switched to another drum, and the full drum is cooled and emptied by conventional methods. Alternatively, feedstock may be supplied to the coker furnace without first passing through a fractionator, as described for example in U.S. Pat. No. 4,518,487.

The delayed coking process employs a furnace that operates at temperatures as high as about 1000° F., roughly 50 to 100° F. higher than the operating temperature of the coke drum. The high furnace temperatures can promote the rapid formation of insoluble coke deposits on the furnace tubes and transfer lines. When coke deposits reach excessive levels, the operation must be shut down and the furnace de-coked. Frequent interruptions for cleaning can lead to high operating costs due to increased amounts of time the operation is off-line, in addition to the costs of the de-coking operations.

Although the process is referred to as "coking", coke is often the least valuable product of the operation. Thus, it is often desirable to minimize the amount of coke produced and maximize the production of other cracked products such as coker gasoline, distillates, and various gas oils. One approach to the problem of furnace fouling is described in U.S. Pat. No. 4,455,219, wherein an internal recycle stream of volatile components produced during the coking operation (for example, flash zone gas oil, heavy coker gas oil, light coker gas oil, and coker naphtha) is substituted for part of the conventional coker heavy recycle stream. This approach reduces furnace fouling when using conventional coker feedstocks, but is not adequate to control furnace fouling when using coker feedstocks having a high propensity for furnace fouling. Although small amounts of feedstocks having a high propensity for furnace fouling can be blended in with conventional coker feedstocks, using them as the primary source of feed or blending them in large amounts with conventional feeds to a coker has not heretofore been feasible because of furnace fouling problems.

Thus, fouling of coker furnaces remains a costly problem.

BRIEF SUMMARY OF THE INVENTION

This invention provides a method for reducing furnace fouling in a delayed coking process by increasing the aromaticity of the coker feedstock upstream of the coker furnace.

For simplicity, the term "aromatic gas oil" is used herein to refer to "an unhydrotreated aromatic gas oil, an unhydrotreated decant oil fraction, and combinations thereof." Similarly, the term "hydrotreated aromatic gas oil" is used herein to refer to "a hydrotreated aromatic gas oil, a hydrotreated decant oil fraction and combinations thereof."

In one embodiment, the invention provides a method for reducing furnace fouling in a delayed coking process in which the coker feed is supplied to the bottom of the coker fractionator to produce an overhead stream, a bottoms stream and at least one intermediate stream and the aromaticity of the bottoms stream is increased by combining with the bottoms stream at least one added stream upstream of the coker furnace to produce a modified stream.

In another embodiment, the invention provides a method for reducing furnace fouling in a delayed coking process in which the coker feed is supplied to the coker furnace without first passing the feed through the fractionator and the aromaticity of the feed is increased by combining with the feed at least one added stream upstream of the coker furnace to produce a modified stream.

DETAILED DESCRIPTION OF THE INVENTION

Figure 1:
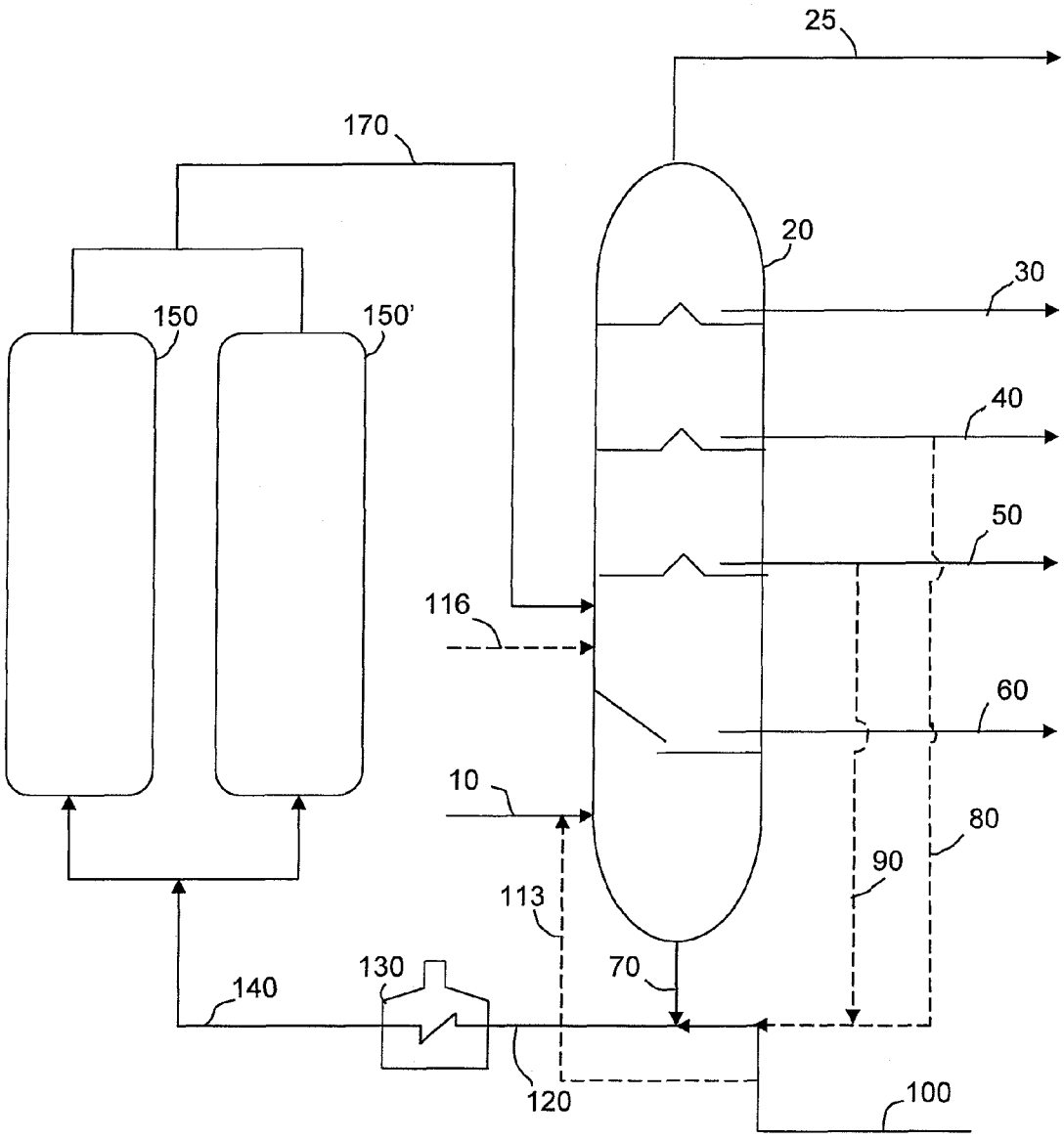
FIG. 1 is a schematic diagram of a delayed coking process in accordance with one embodiment of the present invention in which the coker feedstock is supplied to the bottom of the fractionator.

The present invention provides methods for reducing furnace fouling in a delayed coking process, and thus, can provide longer run times between furnace cleanings.

The present invention provides a method for reducing furnace fouling in a delayed coking process wherein at least one coker feed is supplied to a delayed coking unit comprised of a coker furnace, at least two coke drums and a coker fractionator comprising the steps of (a) increasing the aromaticity of the feed to produce a modified stream by combining with the feed upstream of the coker furnace at least one added stream selected from the group consisting of an aromatic gas oil, a hydrotreated aromatic gas oil and combinations thereof, said aromatic gas oil having an aromatic carbon content of at least about 40% as measured by $^{13}C$ NMR based on the total carbon content of the added stream and said hydrotreated aromatic gas oil having an aromatic carbon content of at least about X % according to the formula $$X=(A\%)-[(0.02)\cdot(\text{hydrogen uptake in the hydrotreater})]$$

where X is as least about 20% as measured by $^{13}C$ NMR based on the total carbon content of the hydrotreated aromatic gas oil and A is the aromaticity of the unhydrotreated aromatic gas oil as measured by $^{13}C$ NMR and is at least about 40%, hydrogen uptake is [ρ·659.5·(Δ hydrogen content (wt %) of the hydrotreater product and feed)] and ρ is the density (grams/cc) of the hydrotreater feed;

(b) introducing the modified stream into the coker furnace;

(c) heating the modified stream to a coking temperature in the coker furnace to produce a heated modified stream; and (d) transferring the heated modified stream from the coker furnace to a coke drum.

In another embodiment, the present invention provides a method for reducing furnace fouling in a delayed coking process wherein at least one coker feed is supplied to a delayed coking unit comprised of a coker furnace, at least two coke drums and a coker fractionator comprising the steps of (a) supplying the feed to the bottom of the fractionator to produce an overhead stream, a bottoms stream and at least one intermediate stream from the fractionator;

(b) increasing the aromaticity of the bottoms stream to produce a modified stream by combining with the bottoms stream upstream of the coker furnace at least one added stream selected from the group consisting of an aromatic gas oil, a hydrotreated aromatic gas oil and combinations thereof, said aromatic gas oil having an aromatic carbon content of at least about 40% as measured by $^{13}C$ NMR based on the total carbon content of the added stream and said hydrotreated aromatic gas oil having an aromatic carbon content of at least about X % according to the formula $$X=(A\%)-[(0.02)\cdot(\text{hydrogen uptake in the hydrotreater})]$$

where X is as least about 20% as measured by $^{13}C$ NMR based on the total carbon content of the hydrotreated aromatic gas oil and A is the aromaticity of the unhydrotreated aromatic gas oil as measured by $^{13}C$ NMR and is at least about 40%, hydrogen uptake is [ρ·659.5·(Δ hydrogen content (wt %) of the hydrotreater product and feed)] and ρ is the density (grams/cc) of the hydrotreater feed;

(c) introducing the modified stream into the coker furnace;

(d) heating the modified stream to a coking temperature in the coker furnace to produce a heated modified stream; and (e) transferring the heated modified stream from the coker furnace to a coke drum.

In yet another embodiment, the present invention provides a method for reducing furnace fouling in a delayed coking process wherein at least one coker feed is supplied to a delayed coking unit comprised of a coker furnace, at least two coke drums and a coker fractionator comprising the steps of (a) supplying the feed to the coker furnace without first passing the feed through the fractionator, (b) increasing the aromaticity of the feed to produce a modified stream by combining with the feed upstream of the coker furnace at least one added stream selected from the group consisting of an aromatic gas oil, a hydrotreated aromatic gas oil and combinations thereof, said aromatic gas oil having an aromatic carbon content of at least about 40% as measured by $^{13}C$ NMR based on the total carbon content of the added stream and said hydrotreated aromatic gas oil stream having an aromatic carbon content of at least about X % according to the formula $$X=(A\%)-[(0.02)\cdot(\text{hydrogen uptake in the hydrotreater})]$$

where X is as least about 20% as measured by $^{13}C$ NMR based on the total carbon content of the hydrotreated aromatic gas oil and A is the aromaticity of the unhydrotreated aromatic gas oil as measured by $^{13}C$ NMR and is at least about 40%, hydrogen uptake is [ρ·659.5·(Δ hydrogen content (wt %) of the hydrotreater product and feed)] and ρ is the density (grams/cc) of the hydrotreater feed;

(c) introducing the modified stream into the coker furnace;

(d) heating the modified stream to a coking temperature in the coker furnace to produce a heated modified stream; and (e) transferring the heated modified stream from the coker furnace to a coke drum.

Coking Process

The following general description of the delayed coking process is described with reference to FIG. 1. Like numerals refer to like components throughout the figures.

Feedstock

Common feedstocks for the production of anode or fuel grade cokes are atmospheric and vacuum resid streams obtained during the distillation of crude oil. For the production of low-sulfur recarburizer coke, pyrolysis tars are often used as the primary feedstock. Often, the feedstock will be a combination of several components, including, but not limited to, crude oil resids, pyrolysis tars, thermal tars, or slurry oils. In addition to the foregoing conventional coker feedstocks, there is an interest in coking feedstocks such as solvent deasphalted pitch, visbreaker bottoms and deep resids having a very high boiling range, such as from 1000° F. and up which have a high propensity to foul the coker furnace, even when relatively high recycle rates are used to dilute the feed to the coker furnace.

System

Referring now to FIG. 1, a feedstock 10 is charged into a fractionator 20 for separation. If desired, feedstock 10 may be passed through one or more heat exchangers (not shown) for preheating before being charged into fractionator 20. The feedstock is usually charged near the base of fractionator 20. It is often practical to recover and/or recycle at least four lower-boiling streams plus a coker wet gas stream 25 from the top of the fractionator. The lower-boiling streams may include: stream 30 comprising coker naphtha and containing $C_5$+ fractions having a boiling point up to about 300-400° F.; stream 40, comprising light coker gas oil (LCGO) having a boiling point typically in the range of from about 300-400° F. up to about 650-780° F.; stream 50, comprising heavy coker gas oil (HCGO) having a boiling point typically in the range of about 650-780° F. to about 950-1050° F.; stream 60, comprising flash zone gas oil having a boiling point above at least about 950-1050° F.; and stream 70, comprising the fractionator bottoms. The coker wet gas stream 25 and coker naphtha stream 30 may be further processed to produce coker gasoline or diesel. The light and heavy coker gas oil streams 40 and 50 may be internally recycled, sold, or used in other processes in the refinery. The fractionator bottoms 70 are generally used to produce coke.

Still referring to FIG. 1, an optional recycle stream 80 and/or 90 is taken from at least one of light and heavy coker gas oil streams 40 and 50, respectively as discussed below and may be added to fractionator bottoms stream 70. In preferred embodiments, a stream 100 comprising aromatic gas oil is added to fractionator bottoms stream 70 to form modified stream 120. Modified stream 120 is passed through a coker furnace 130 to be heated to coking temperatures. The temperature of the coker feed as it exits the furnace via stream 140 can be as high as 950 to about 960° F.

Figure 3:
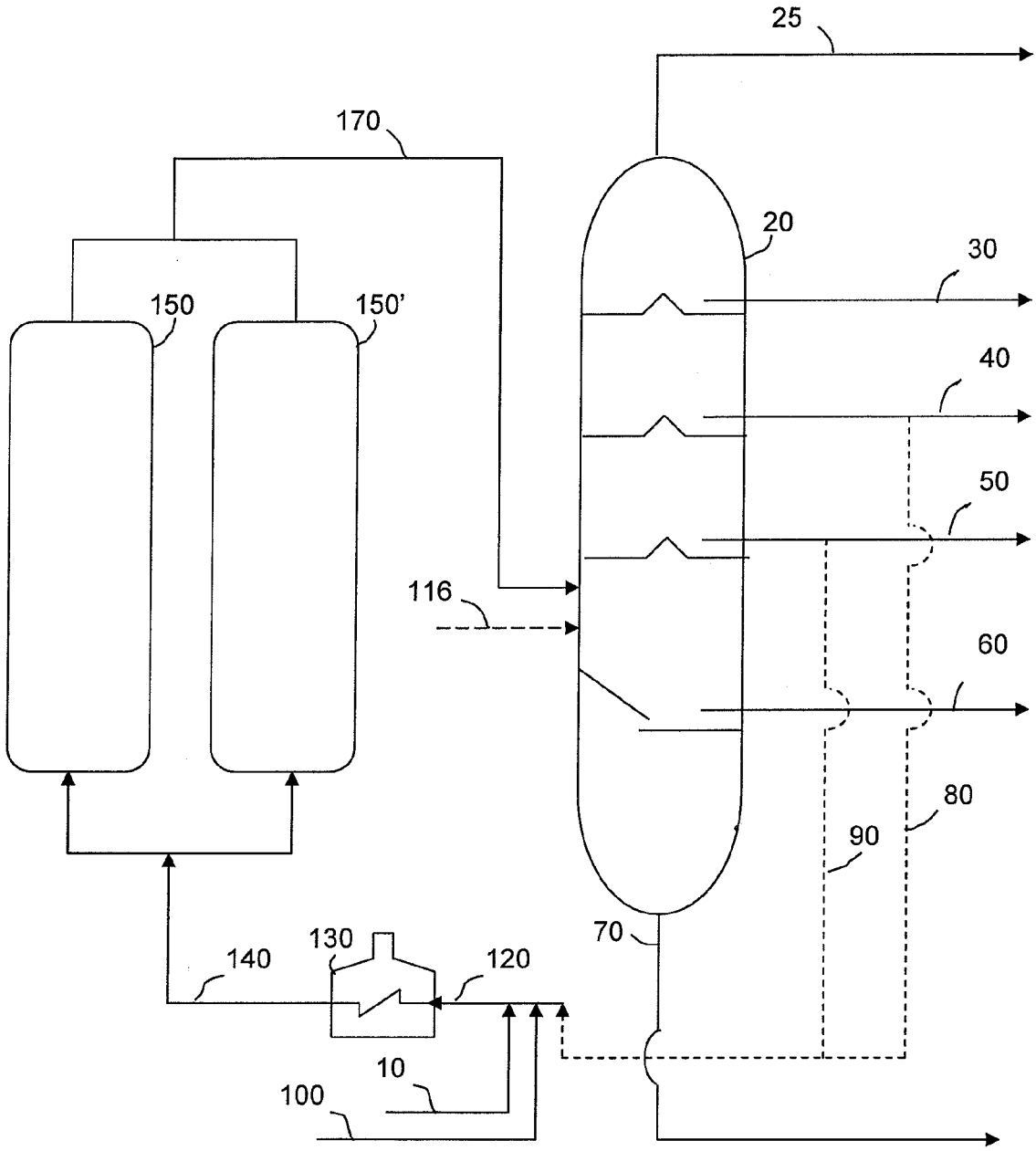
FIG. 3 is a schematic diagram of a delayed coking process in accordance with another embodiment of the present invention in which the coker feedstock is supplied to the furnace without first passing through the fractionator.

Another embodiment of the delayed coking process is described with reference to FIG. 3, in which feedstock 10 is charged to the coker furnace 130 without first passing through fractionator 20. In preferred embodiments, a stream 100 comprising aromatic gas oil is added to the feedstock 10 to form modified stream 120 upstream of the coker furnace 130. The light and heavy coker gas oil streams 40 and 50 may be internally recycled as optional recycle stream 80 and/or 90 and added to modified stream 120, or they may be sold, or used in other processes in the refinery.

Coking

Referring again to FIG. 1, heated coker feed stream 140 exits coker furnace 130 and is transferred to one or more coke drums 150, 150' via one or more transfer lines where it is maintained at coking temperatures and pressures.

During the retention time in coke drum 150, heated stream 140 decomposes into coke and lighter hydrocarbons, which are vaporized and removed from the drum as overhead vapors 170. Overhead vapors 170 from coke drum 150 are returned to coker fractionator 20 for recovery and possible recycle to the coke drum via line 120. When coke drum 150 is full of solid coke, the heated stream 140 is switched to another coke drum 150', and the full drum is cooled and emptied by conventional methods.

Coker Feed Modification

Figure 4:
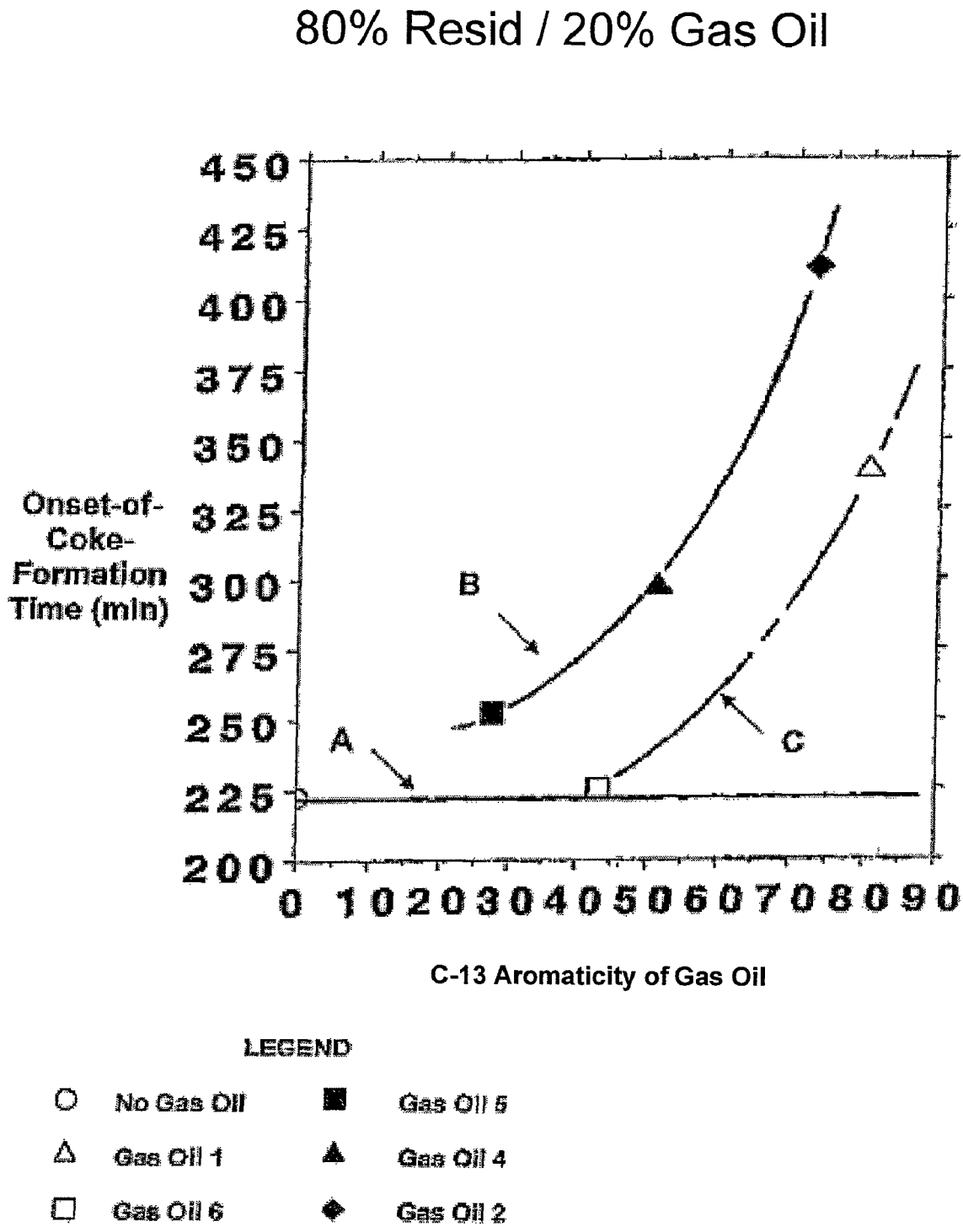
FIG. 4 is a plot comparing the temperature-corrected onset-of-coke-formation times for various resid/gas oil mixtures plotted as a function of gas oil aromaticity.
Figure 5:
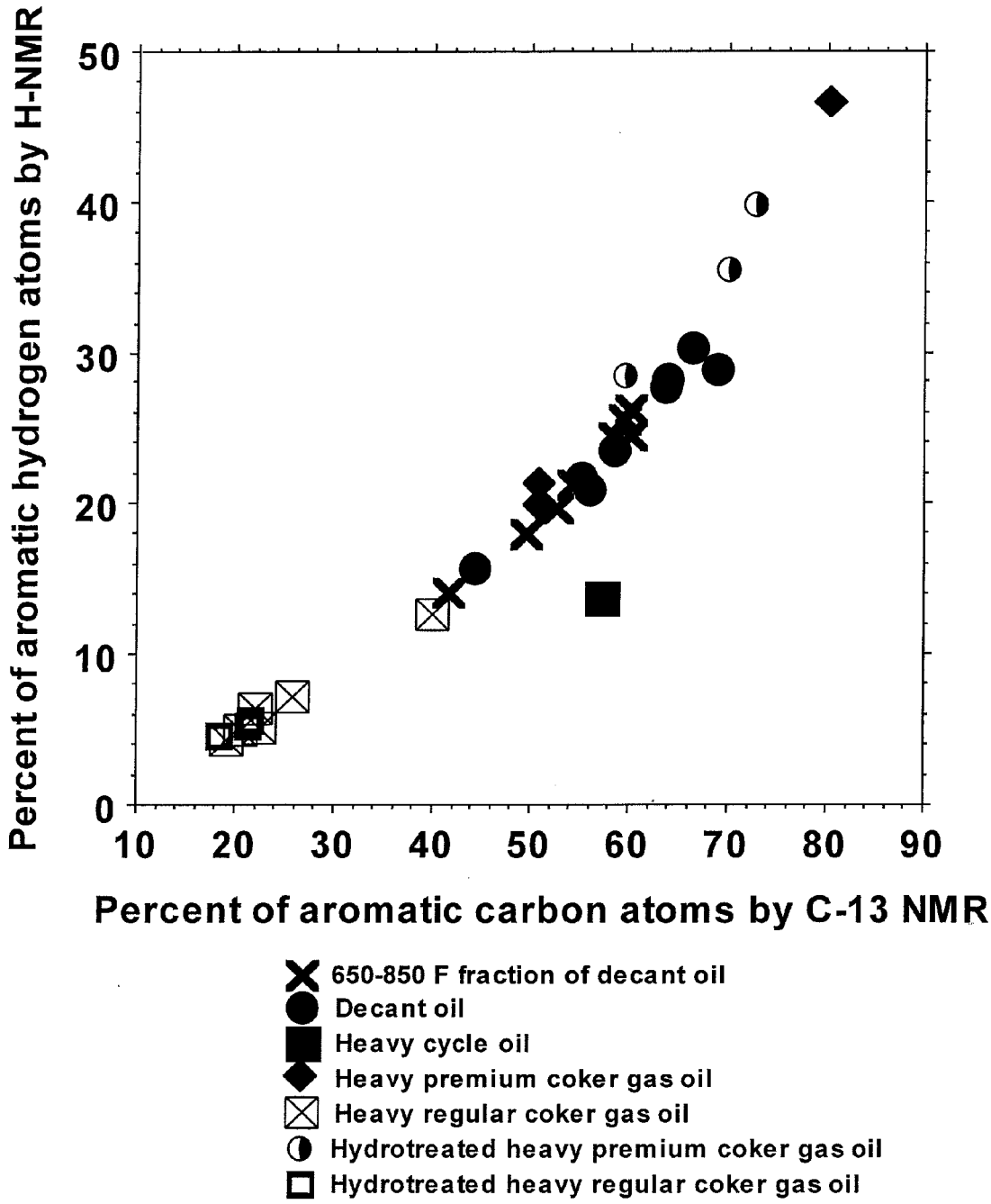
FIG. 5 is a plot showing feed aromaticity as measured by H NMR vs. feed aromaticity as measured by $^{13}C$ NMR.
Figure 6:
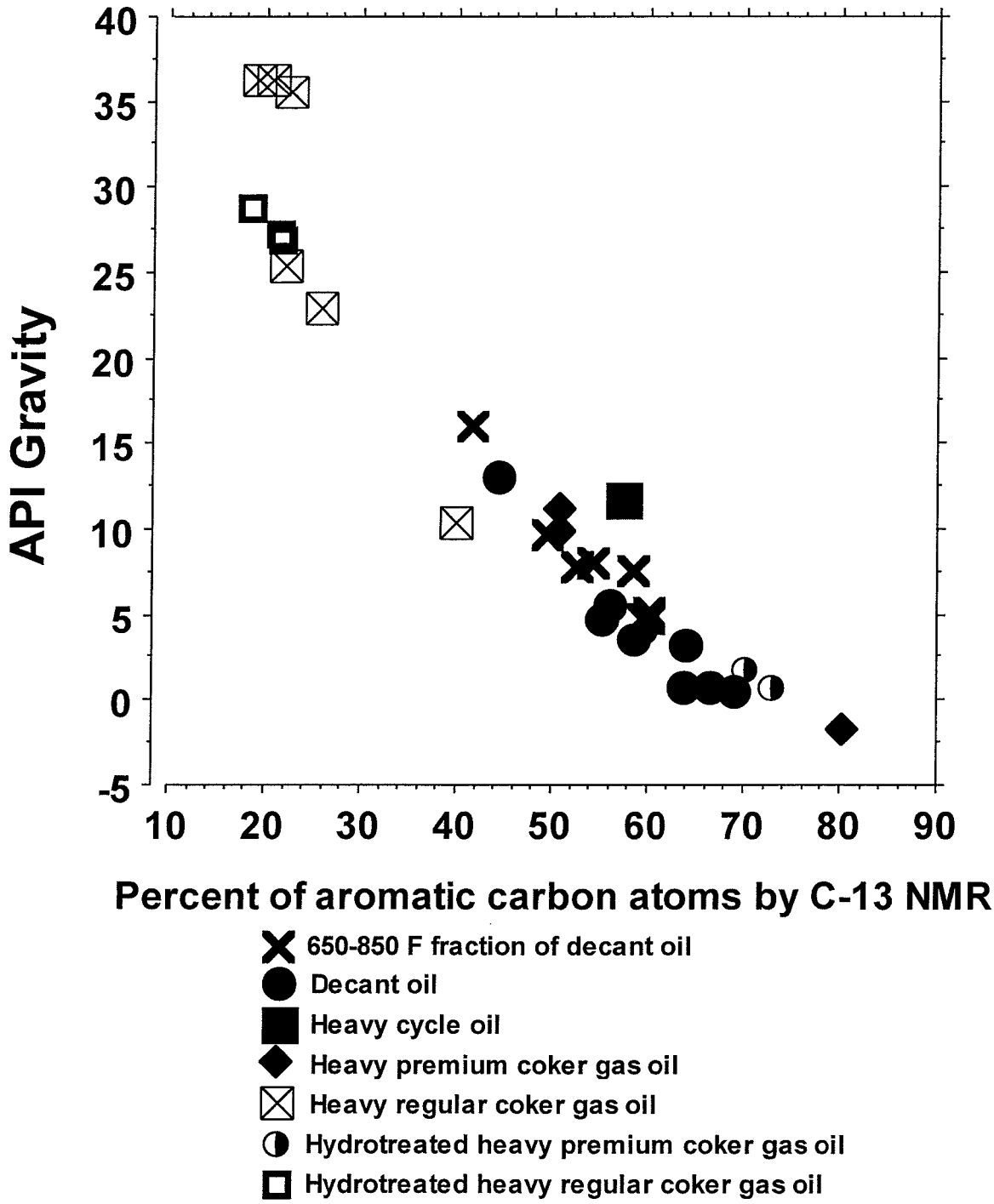
FIG. 6 is a plot showing feed API gravity vs. feed aromaticity as measured by $^{13}C$ NMR.
Figure 7:
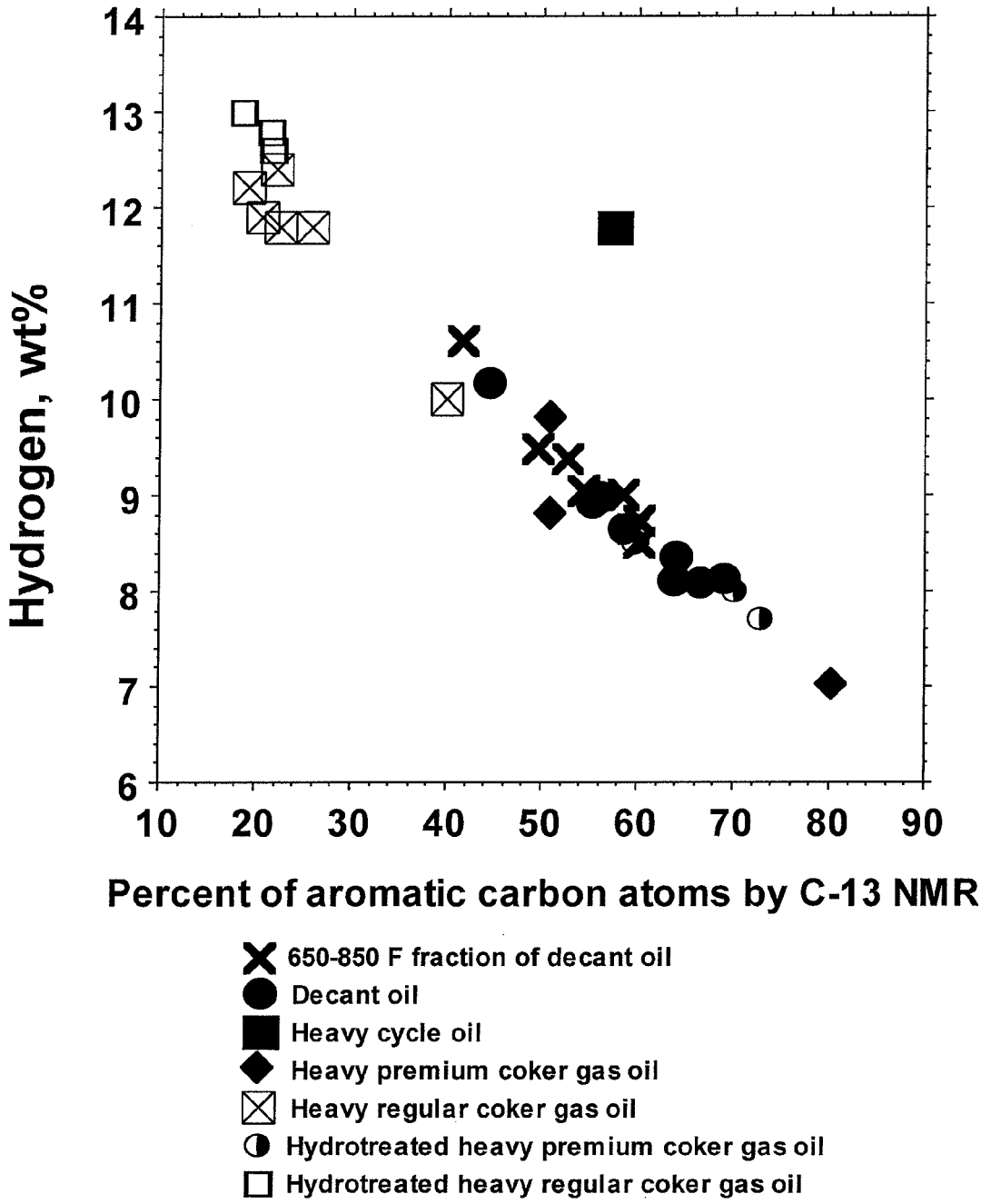
FIG. 7 is a plot showing feed hydrogen content vs. feed aromaticity as determined by $^{13}C$ NMR.

The aromaticity of the gas oil in modified stream 120 has been correlated to the coking propensity of the modified stream 120, as determined by the onset-of-coke-formation time ("OCFT"). As can be seen in FIG. 4, the OCFT generally increases as the aromaticity of the gas oil (in a blend with bottoms stream 70) increases. Aromaticity can be determined by $^{13}$C NMR or any other suitable means, such as H NMR, API gravity, or Watson K factor. FIGS. 5 and 6 illustrate the correlation between aromaticity as determined by $^{13}$C NMR and aromaticity as determined by H NMR and API gravity, respectively. FIG. 7 illustrates the correlation between feed hydrogen content and aromaticity as determined by $^{13}$C NMR. Because of the correlation between aromaticity and OCFT, it is desirable to increase the aromaticity of modified stream 120.

Reductions in the coking propensities of feedstocks have also been linked with the selection of particular fractions of the added stream used to form modified stream 120. In particular, aromatic gas oils that boil between about 650 and about 1,000° F. have shown an improved ability to reduce the coking propensity of coker furnace feed streams when added to those streams. Still more particularly, the added streams preferably have a boiling point in a range of about 750 to about 950° F., and more preferably between about 750 and about 850° F.

Thus, according to the present invention, fouling is decreased by increasing the aromaticity of the coker feedstock upstream of the coker furnace. The desired increase in aromaticity can be achieved through the addition of streams having certain desired properties to the coker feed stream. As described in detail below, the additional streams may comprise one or more of the recycle fractions from fractionator 20 and at least one of aromatic gas oil stream 100 or decant oil stream 116.

Referring to FIG. 1, the aromaticity of modified stream 120 is increased by adding a portion of at least one of the fractionated streams to the fractionator bottoms 70 as internal recycle stream 80 and/or 90, so as to reduce the coking propensity of the modified stream before it enters furnace 130. The internal recycled gas oil preferably comprises at least a portion of light coker gas oil stream 40 and heavy coker gas oil stream 50. The selection of the recycled stream from the various fractions exiting fractionator 20 depends on the properties of the coker feedstock, as does the amount of recycle that is used. In addition, the recycled stream(s) can be supplemented and/or can be hydrotreated or otherwise processed prior to being added to the fractionator bottoms, as described below.

In certain embodiments of the present invention, an aromatic gas oil stream 100 is added to fractionator bottoms stream 70 to reduce the coking propensity of bottoms stream 70. Aromatic gas oil stream 100 may comprise an aromatic gas oil from a needle coker operation (referred to as a premium coker gas oil) or heavy cycle oil from a fluid catalytic cracking (FCC) process. In some embodiments, aromatic gas oil stream 100 may also include hydrocarbons from other refinery processes such as a thermal cracker, so long as aromatic gas oil stream 100 boils between roughly 650 and 1000° F. Aromatic gas oil stream 100 preferably has a carbon aromaticity of at least about 40% and more preferably at least about 50% and still more preferably at least about 60% as measured by $^{13}$C NMR based on the total carbon content of the aromatic gas oil.

As an alternative or in addition to aromatic gas oil stream 100, a decant oil stream 116 can be added to fractionator 20 just above the flash zone gas oil tray. Decant oil stream 116 preferably has an aromatic carbon content of at least 40% and more preferably at least 50% and still more preferably at least 60% as measured by $^{13}$C NMR based on the total carbon content of the decant oil. Likewise, decant oil stream 116 preferably boils between 650 and 950° F., but can contain material boiling above 950° F. because this higher boiling material will be removed from the fractionator via line 60. Thus, most of the hydrocarbons added via decant oil stream 116 will tend to leave fractionator 20 along with the HCGO via line 50 and thereby increase the volume and aromatic carbon content of recycle stream 90, which if used as recycle will further reduce the coking propensity of the coker feed stream before it enters furnace 130.

The amount of hydrocarbons added to bottoms stream 70 will vary depending on many process variables, including feedstock composition, feedstock quality, amount of recycle, furnace design, and furnace operating conditions. For feedstocks 10 having a higher tendency for coker furnace fouling, a greater amount of aromatic gas oil may be necessary. In many embodiments, the volume of aromatic gas oil stream 100 is such that aromatic gas oil stream 100 preferably comprises from about 1 up to about 50 wt %, and more preferably from about 5 up to about 40 wt %, and still more preferably from about 20 up to about 40 wt %, of modified stream 120, based on the total weight of modified stream 120. In some embodiments, a portion 113 (shown in phantom in FIG. 1) of aromatic gas oil stream 100 may be added to feed 10 and recycled through fractionator 20.

The hydrocarbons in aromatic gas oil stream 100 may be selected from (a) a gas oil having an aromatic carbon content of at least about 40% and more preferably about 50% and still more preferably about 60% based on the total carbon content of the gas oil, measured by $^{13}C$ NMR; (b) a hydrotreated aromatic gas oil having an aromatic carbon content measured by $^{13}C$ NMR of at least about X % according to the formula X=(A %)−[(0.02)·(hydrogen uptake in the hydrotreater)], where X is at least about 20% as measured by $^{13}C$ NMR based on the total carbon content of the hydrotreated aromatic gas oil and more preferably about 30% and still more preferably about 40%, and A is the aromaticity of the unhydrotreated aromatic gas oil as measured by $^{13}C$ NMR analysis and is at least about 40%, hydrogen uptake is defined as [ρ·659.5·(Δ hydrogen content (wt %) of the hydrotreater product and feed)] and ρ is defined as the density (grams/cc) of the hydrotreater feed; (c) a hydrotreated aromatic gas oil of (b) having a hydrogen uptake of between about 200 and 1000 SCFB; (d) an aromatic gas oil of (a) having an aromatic carbon content measured by $^{13}C$ NMR of at least about 40% based on the total carbon content of the gas oil and a boiling point in a range of about 650 to about 1,000° F.; or (e) a hydrotreated aromatic gas oil of (b) having a boiling point in a range of about 650 to about 1,000° F. An aromatic carbon content greater than 40% measured by $^{13}C$ NMR corresponds roughly to having greater than 13% of hydrogen atoms in the aromatic form as measured by H NMR analysis (FIG. 5), gravity less than 15 deg API (FIG. 6), or hydrogen content less than 10.5 wt %. Hydrotreating is described below. Items (d) and (e) above have boiling points between 650 and 1000° F. Because the entry for decant oil stream line 116 is above the flash zone gas oil (FZGO) tray in the fractionator, high-boiling components of the decant oil stream will leave the fractionator with other flash zone gas oil in line 60. In contrast, any high-boiling components that are added via aromatic gas oil stream 100 will enter the coker and may cause undesirable fouling.

Likewise, the hydrocarbons in decant oil stream 116 may be selected from any of the sources (a)-(c) identified in the preceding paragraph. However, decant oil stream 116 can be different from stream aromatic gas oil stream 100 in that decant oil stream 116, in addition to containing material boiling between 650° F. and 1000° F., also can contain material boiling above 1000° F. Decant oil from a fluid catalytic converter is one example of a type of material that would be used in decant oil stream 116, but not in aromatic gas oil stream 100.

Hydrotreated Gas Oil

Figure 2:
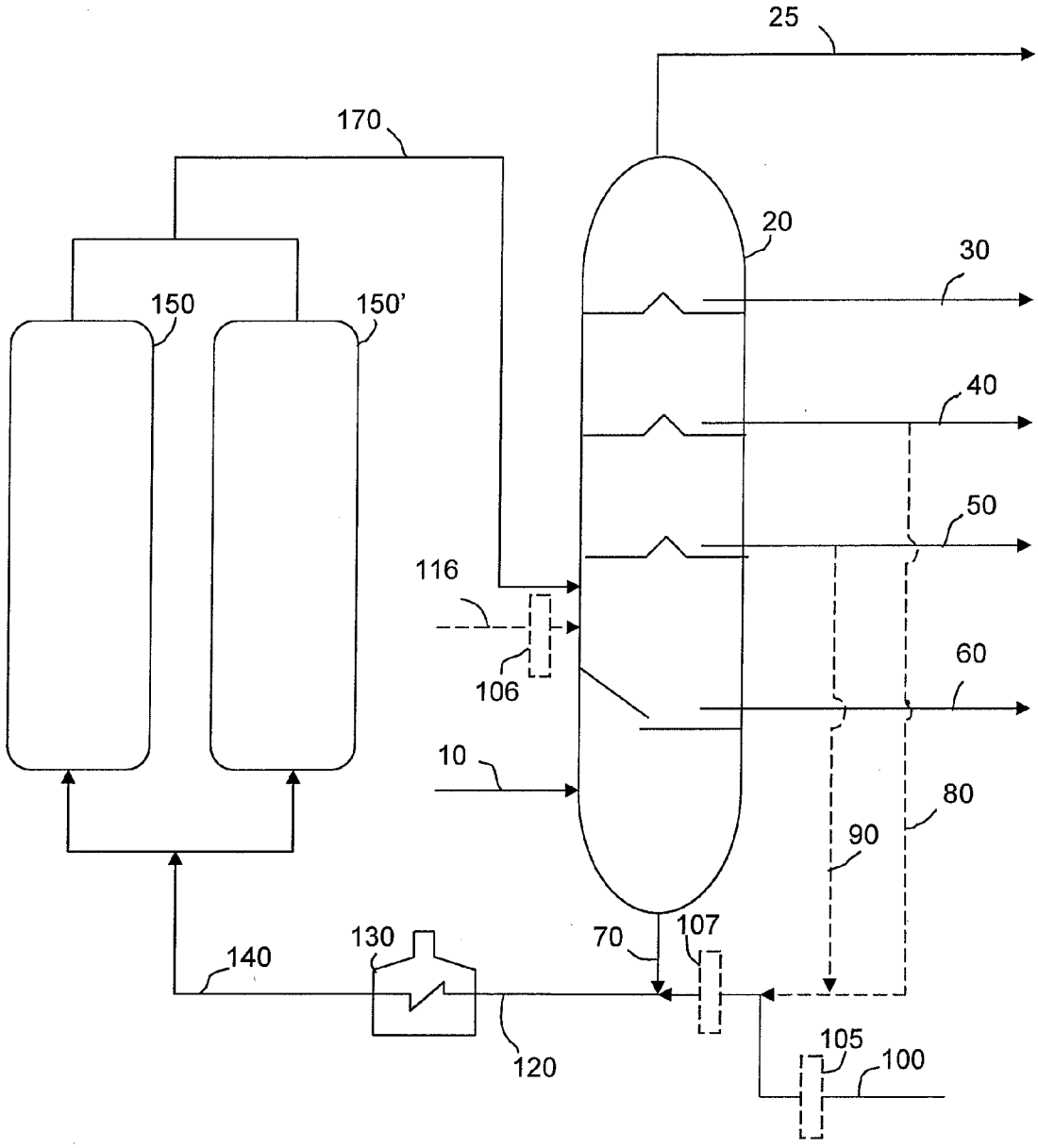
FIG. 2 is a schematic diagram of a delayed coking process illustrated in FIG. 1 that further includes hydrotreatment steps.

In some embodiments of the present invention, all or a portion of streams 100, 116, 80 and/or 90 may be hydrotreated. As shown in FIG. 2, optional hydrotreaters 105, 106, and/or 107 can be included in order to hydrotreat streams 100, 116, 80 and/or 90 respectively. Although hydrotreatment conditions can vary depending upon the stream properties, conditions generally include temperatures in the range of about 600° to about 750° F., a hydrogen partial pressure of about 350 to about 2,000 psig, a liquid hourly space velocity (LHSV) in the range of about 0.2 to about 3, and a hydrogen rate in the range of about 1,000 to about 4,000 standard cubic feet per barrel of gas oil. Conventional catalysts for hydrotreatment include supported nickel-molybdenum ("Ni/Mo") or cobalt-molybdenum ("Co/Mo") catalysts.

Figure 8:
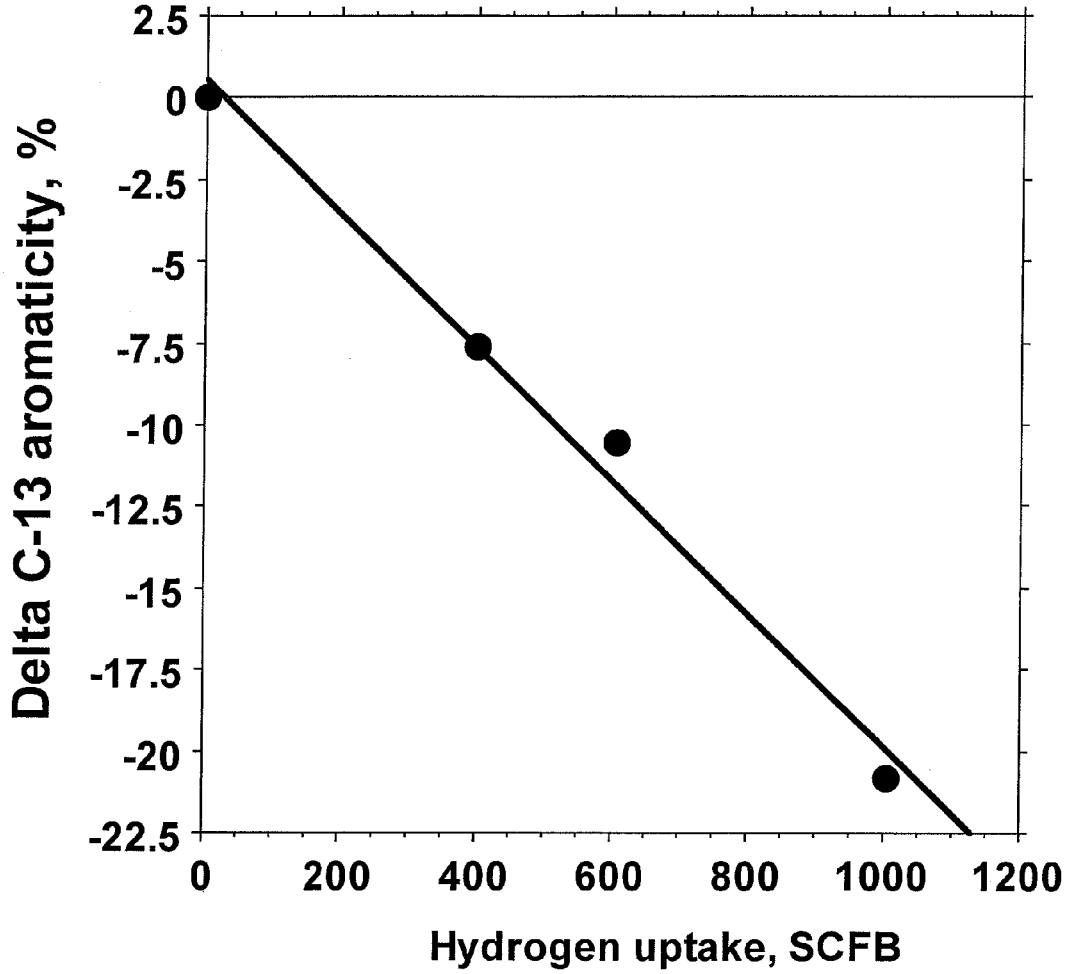
FIG. 8 is a plot showing the change in feed aromaticity as measured by $^{13}C$ NMR vs. hydrogen uptake during hydrotreating of a premium coker gas oil.

Aromatic gas oils hydrotreated at any level demonstrate an improved ability to reduce the coking propensity of resid/tar feedstocks as compared to unhydrotreated aromatic gas oil. FIG. 8 is a plot showing the change in feed aromaticity as measured by $^{13}C$ NMR vs. hydrogen uptake during hydrotreating of a premium coker gas oil. As can be seen, there is a linear relationship between aromaticity and hydrogen uptake, with an increase of 1000 SCFB in hydrogen uptake corresponding to about a 20% decrease in aromaticity.

Generally, the OCFT increases as the hydrogen uptake of the gas oil increases. Thus, in one embodiment of the present invention, the aromatic gas oil is hydrotreated to give a hydrogen uptake of at least about 200 standard cubic feet per barrel (SCFB), more preferably at least about 300 SCFB, still more preferably at least about 500 SCFB, and still more preferably at least about 1,000 SCFB. In still a further embodiment, the hydrogen uptake by the decant oil is in a range of about 200 to about 1,000 SCFB.

EXAMPLES

The following examples are presented for purposes of illustration, and are not intended to impose limitations on the scope of the invention.

Instrumentation

Gas oil aromaticity was measured using $^{13}C$ NMR analysis. Hydrogen uptake by the gas oil was determined by measuring the difference in hydrogen content of the feedstock after passing through the hydrotreater using the following equation:

$$\text{Hydrogen uptake}=\rho\cdot 658.5\cdot(\Delta H)$$

where ρ=density (g/cc) of the hydrotreater feed and ΔH=difference in hydrogen content (wt %) of the hydrotreater product and feed.

The coking propensity of each sample resid and resid/gas oil mixture was determined from OCFTs, measured using the coking propensity test method and apparatus described in International Publication No. WO 01/53813, incorporated herein by reference in its entirety for all purposes. The test method measures the propensity of liquid feedstocks to form coke when heat and pressure are applied. The test apparatus comprises a container or reactor outfitted with a heater cartridge having a hot zone for heating liquid feedstock, a liquid thermocouple to measure the temperature of the liquid feedstock, and a heater thermocouple for measuring the temperature of the heater cartridge hot zone. During measurement of coking propensity, a thermocouple located inside the cartridge is controlled at constant temperature. As coke forms or solids deposit on the surface of the heater, an insulating barrier is formed which reduces the power required to maintain the desired constant cartridge temperature. The time to decrease the power required to maintain the heater at the desired temperature determines the propensity for coking of the liquid feedstock.

Sample Preparation

Hydrotreatment of gas oils was carried out using a hydrotreater pilot plant. Gas oils were fractionated in the laboratory at 2 mm Hg in a D-1160 apparatus.

Example 1

Coking Propensities of Feedstocks Modified with Various Gas Oils

A resid feedstock having physical properties as shown in Table I was tested using the coking propensity apparatus described in International Publication No. WO 01/53813. Also tested were blends consisting of about 80 wt % of the resid with about 20 wt % of each of the gas oils listed below in Table I.

TABLE I

| Gas Oil Properties | |
|---|---|
| GAS OIL # | DESCRIPTION |
| 1 | Aromatic needle coker gas oil |
| 2 | Gas oil 1, hydrotreated with a Co/Mo catalyst to give a hydrogen uptake of about 400 SCFB |
| 3 | Gas oil 1, hydrotreated with a Ni/Mo catalyst to give a hydrogen uptake of about 1,000 SCFB |
| 4 | Less aromatic needle coker gas oil, hydrotreated with a Co/Mo catalyst to give a hydrogen uptake of about 370 SCFB |
| 5 | Blend of virgin non-needle coker gas oil and less aromatic needle coker gas oil, hydrotreated with a Ni/Mo catalyst to give a hydrogen uptake of about 480 SCFB |
| 6 | Flash zone gas oil from a delayed coking operation for production of fuel coke |

The properties and OCFT data for each sample tested with the coking propensity apparatus are summarized in Table II. Because the OCFT is very sensitive to liquid temperature, the corrected OCFT for each sample is also listed. The corrected OCFT is obtained by using an Arrhenius thermal severity factor to normalize experimental data to a constant level of liquid temperature. As shown below, unmodified resids have much shorter OCFT times, and thus, higher coking propensities, than those modified with 20 Wt % aromatic gas oil or hydrotreated aromatic gas oil.

TABLE II

Coking Propensity Results (Example 1)

| Run No. | Gas Oil Additive | API | Hydrogen Uptake (SCFB) | % Aromatic Carbons ($^{13}$C NMR) | Avg. Liquid Temp (° F.) | OCFT (min) | Corrected OCFT (min) |
|---|---|---|---|---|---|---|---|
| 190 | None | — | — | — | 730 | 177 | 226 |
| 191 | None | — | — | — | 738 | 141 | 219 |
| 197 | None | — | — | — | 726 | 194 | 223 |
| | | | | | | AVG: | 223 |
| 192 | #1 | −1.8 | 0 | 80.4 | 742 | 198 | 339 |
| 194 | #2 | 0.7 | 400 | 72.8 | 755 | 175 | 411 |
| 195 | #3 | 4.0 | 1003 | 59.6 | 747 | 220 | 425 |
| 196 | #4 | 11.1 | 368 | 51.1 | 730 | 233 | 297 |
| 193 | #5 | 22.2 | 480 | 27.5 | 746 | 134 | 253 |
| 216 | #6 | 14.4 | 0 | 43.2 | 731 | 173 | 226 |

Figure 9:
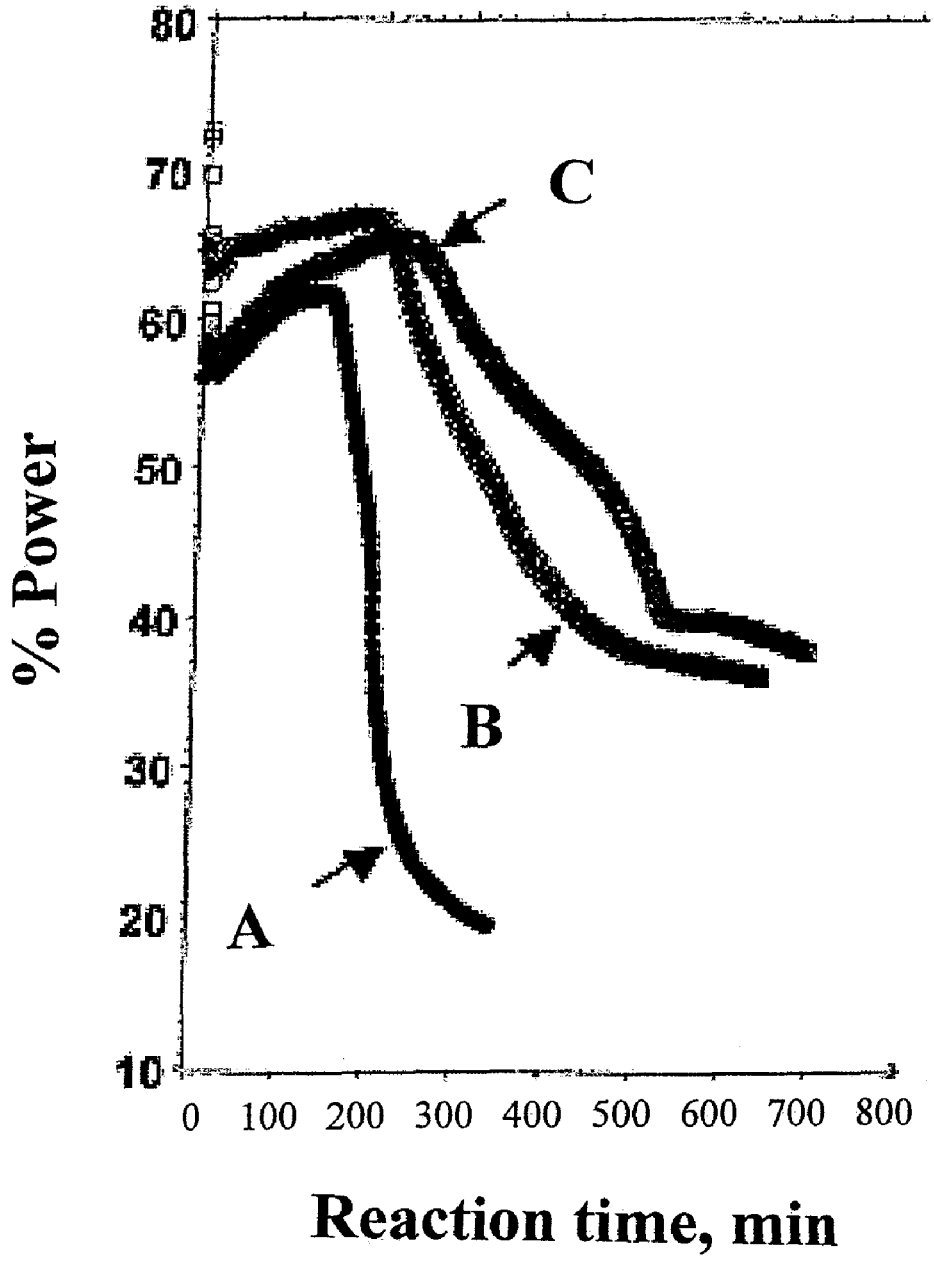
FIG. 9 is a plot comparing coking propensity results for an unmodified resid, a resid modified with an aromatic gas oil, and a resid modified with a hydrotreated aromatic gas oil.

FIG. 9 illustrates the coking propensity results for an unmodified resid at 738° F. liquid temperature (Curve A), a resid modified with 20 wt % aromatic gas oil 1 of Table 1 at 742° F. liquid temperature (Curve B), and a resid modified with 20 wt % hydrotreated aromatic gas oil 3 of Table 1 at 747° F. liquid temperature (Curve C). The graph plots the percent power necessary to maintain the coking propensity apparatus heater at a constant internal temperature as a function of time. The time at which the power curve begins decreasing is indicative of the OCFT. Because coke acts as an insulator, less power is required to maintain a constant internal temperature when the cartridge heater is fouled by coke deposition. As can be seen in FIG. 9, the unmodified resid (Curve A) exhibits an onset of coke formation after approximately 135 minutes. In contrast, the onset of coke formation for the resid modified with aromatic gas oil 1 (Curve B) occurs after approximately 220 minutes, while the resid modified with gas oil 3, which is a hydrotreated aromatic gas oil (Curve C), has an OCFT of approximately 250 minutes. These results show that coker furnace fouling is reduced by modifying a resid with an aromatic gas oil, and that an even greater reduction in furnace fouling is achieved by modifying a resid with a hydrotreated aromatic gas oil.

Figure 10:
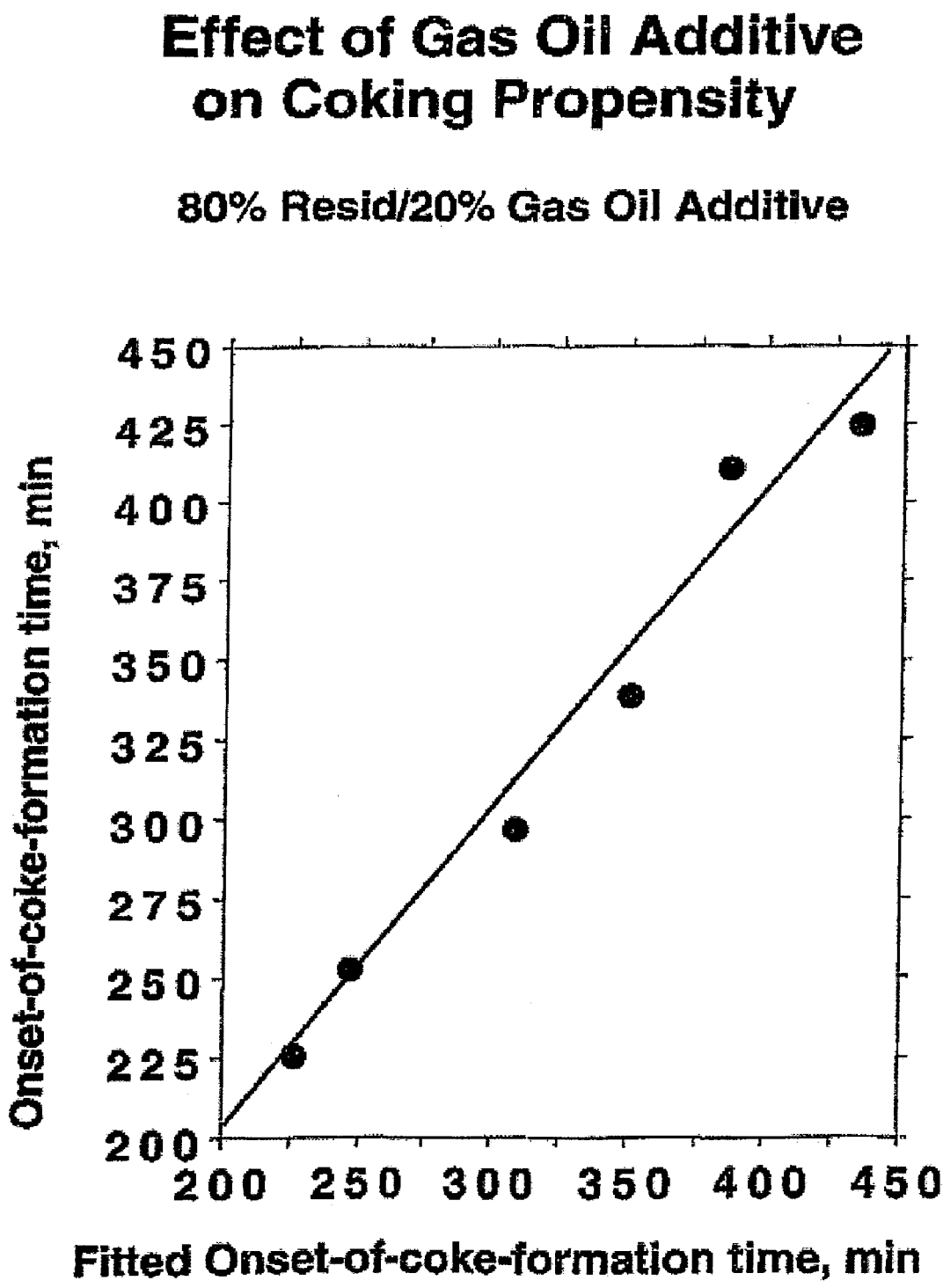
FIG. 10 is a plot showing the results of multiple linear regression analysis comparing onset-of-coke-formation time to gas oil $^{13}C$ NMR aromaticity and hydrogen uptake in standard cubic feet per barrel (SCFB).

FIG. 4 illustrates the corrected OCFT as a function of % gas oil aromaticity. Line A represents the average corrected OCFT for the unmodified resid (223 minutes). Curve B represents the resids modified with hydrotreated gas oils having a hydrogen uptake of approximately 400 SCFB (gas oils 2, 4, and 5). Curve C represents the resids modified with gas oils that were not hydrotreated (gas oils 1 and 6). FIG. 4 clearly shows that the OCFT increases both as the gas oil aromaticity increases and as the hydrogen uptake by the gas oil increases. FIG. 10 illustrates a multiple linear regression analysis for these coking propensity results. FIG. 10 demonstrates with high correlation that the OCFT is linearly proportional to roughly 3.3 times the gas oil $^{13}$C NMR aromaticity and approximately 0.15 times the hydrogen uptake of the gas oil in SCFB. Statistical data for the regression analysis is presented below in Table III.

TABLE III

Multiple Linear Regression Analysis

| | Coefficient | Std. Error | Std. Coefficient | t value | P value |
|---|---|---|---|---|---|
| Intercept | 81.48126 | 27.16063 | 81.48126 | 2.99998 | 0.0577 |
| $^{13}$C NMR aromaticity | 3.34042 | 0.42454 | 0.79515 | 7.86832 | 0.0043 |

TABLE III-continued

Multiple Linear Regression Analysis

| | Coefficient | Std. Error | Std. Coefficient | t value | P value |
|---|---|---|---|---|---|
| Hydrogen uptake (SCFB) | 0.15307 | 0.02233 | 0.69288 | 6.85628 | 0.0064 |

Example 2

Coking Propensities of Feedstocks Modified with Fractionated Gas Oils

Gas oils 1 and 3 were each fractionated to produce a 750-850° F. fraction and an 850+° F. fraction. These fractions were mixed with the resid from Example 1 in a proportion of about 80 wt % resid and about 20 wt % gas oil. The properties and OCFT data for these samples are summarized in Table IV.

TABLE IV

Coking Propensity Results (Example 2)

| Run No. | Gas Oil Modifier | Avg. Liquid Temp (° F.) | OCFT (min) | Corrected OCFT (min) |
|---|---|---|---|---|
| 202 | None | 700 | 385 | 236 |
| 203 | None | 756 | 85 | 204 |
| 208 | None | 735 | 157 | 226 |
| | | | AVG: | 222 |
| 204 | 16 wt % of 750-850° F. fraction of gas oil #1 | 753 | 138 | 309 |
| 205 | 20 wt % of 850+° F. fraction of gas oil #1 | 734 | 187 | 263 |
| 206 | 20 wt % of 750-850° F. fraction of gas oil #3 | 747 | 189 | 365 |
| 207 | 18.3 wt % of 850+° F. fraction of gas oil #3 | 705 | 231 | 160 |

The data in Table IV demonstrate that the 750-850° F. fraction is more effective than the 850+° F. fraction at slowing coke formation, particularly in the case of hydrotreated gas oil #3.

Example 3

Coking Propensities of Feedstocks Modified with Fractionated Gas Oils

Gas oil 6, which was less effective at slowing coke formation than the other gas oils tested in Example 1, was fractionated to produce a 750-850° F. fraction and a fraction boiling below 950° F. These fractions were mixed with the resid from Example 1 in a proportion of about 80 wt % resid and about 20 wt % gas oil. The properties and OCFT data for these samples are summarized in Table V.

TABLE V

Coking Propensity Results (Example 3)

| Run No. | Gas Oil Additive | Avg. Liquid Temp (° F.) | OCFT (min) | Corrected OCFT (min) |
|---|---|---|---|---|
| 213 | None | 731 | 162 | 212 |
| 219 | None | 724 | 200 | 243 |
| | | | AVG: | 227 |
| 217 | 20 wt % of 750-850° F. fraction of gas oil #6 | 742 | 139 | 238 |
| 218 | 20 wt % of 950−° F. fraction of gas oil #6 | 737 | 165 | 250 |
| 216 | Gas oil #6 | 731 | 173 | 226 |

Table V illustrates results similar to those of Example 2, specifically, that separating out the highest molecular weight fraction of the gas oil makes the gas oil more effective at slowing the onset of coke formation.

The foregoing description of preferred embodiments of this invention is intended to be illustrative and is not intended to impose any limitations on the scope of the invention.

The invention claimed is:

1. A method for reducing furnace fouling in a delayed coking process for producing anode or fuel grade coke wherein at least one coker feed is supplied to a delayed coking unit comprised of a coker furnace, at least two coke drums and a coker fractionator comprising (a) increasing the aromaticity of the feed to produce a modified stream by combining with the feed upstream of the coker furnace a hydrotreated aromatic gas oil wherein the hydrotreated aromatic gas oil is formed from an unhydrotreated aromatic gas oil in a hydrotreater wherein the hydrotreater has a hydrotreater product and a hydrotreater feed, and wherein the hydrotreated aromatic gas oil has an aromatic carbon content of at least about X % according to the formula $$X=(A\%)-[(0.02)\cdot(\text{hydrogen uptake in a hydrotreater})]$$

where X is as least about 20% as measured by 13C NMR based on the total carbon content of the hydrotreated aromatic gas oil and A is the aromaticity of a unhydrotreated aromatic gas oil as measured by 13C NMR and is at least about 40%, where hydrogen uptake is [ρ·659.5·(Δ hydrogen content (wt %) of the hydrotreater product and the hydrotreater feed)] and where ρ is the density (grams/cc) of the hydrotreater feed;

(b) introducing the modified stream into the coker furnace;

(c) heating the modified stream to a coking temperature in the coker furnace to produce a heated modified stream; and (d) transferring the heated modified stream from the coker furnace to a coke drum.

2. The method of claim 1 wherein the hydrotreated aromatic gas oil has an aromatic carbon content of at least about 50% as measured by as measured by 13C NMR based on the total carbon content.

3. The method of claim 1 wherein the hydrotreated aromatic gas oil has an aromatic carbon content of at least about 60% as measured by as measured by 13C NMR based on the total carbon content.

4. The method of claim 1 wherein step (a) is carried out such that the amount of the hydrotreated aromatic gas oil is between about 1 wt % up to about 50 wt % of the modified stream.

5. The method of claim 1 wherein step (a) is carried out such that the hydrotreated aromatic gas oil is between about 20 wt % to about 40 wt % of the weight of the modified stream.

6. The method of claim 1 wherein the hydrotreated aromatic gas oil has a boiling point in a range of about 650 to about 1,000° F.

7. The method of claim 1 wherein the hydrotreated aromatic gas oil has a boiling point in a range of about 750 to about 850° F.

8. The method of claim 1 wherein the hydrotreated aromatic gas oil has an aromatic carbon content of at least about 30% as measured by as measured by 13C NMR based on the total carbon content.

9. The method of claim 8 wherein the hydrogen uptake of the hydrotreated aromatic gas oil is at least about 150 SCFB.

10. The method of claim 8 wherein the hydrogen uptake of the hydrotreated aromatic gas oil is at least about 500 SCFB.

11. The method of claim 8 wherein the hydrogen uptake of the hydrotreated aromatic gas oil is at least about 1000 SCFB.

12. The method of claim 1 wherein the hydrotreated aromatic gas oil has an aromatic carbon content of at least about 40% as measured by as measured by 13C NMR based on the total carbon content.

13. A method for reducing furnace fouling in a delayed coking process wherein at least one coker feed is supplied to a delayed coking unit comprised of a coker furnace, at least two coke drums and a coker fractionator comprising (a) supplying the feed to the bottom of the fractionator to produce an overhead stream, a bottoms stream and at least one intermediate stream from the fractionator;

(b) increasing the aromaticity of the bottoms stream to produce a modified stream by combining with the bottoms stream upstream of the coker furnace a hydrotreated aromatic gas oil wherein the hydrotreated aromatic gas oil is formed from an unhydrotreated aromatic gas oil in a hydrotreater wherein the hydrotreater has a hydrotreater product and a hydrotreater feed, and wherein the hydrotreated aromatic gas oil has an aromatic carbon content of at least about X % according to the formula $$X=(A\%)-[(0.02)\cdot(\text{hydrogen uptake in a hydrotreater})]$$

where X is as least about 20% as measured by 13C NMR based on the total carbon content of the hydrotreated aromatic gas oil and A is the aromaticity of a unhydrotreated aromatic gas oil as measured by 13C NMR and is at least about 40%, where hydrogen uptake is [ρ659.5·(Δ hydrogen content (wt %) of the hydrotreater product and the hydrotreater feed)] and where ρ is the density (grams/cc) of the hydrotreater feed;

(c) introducing the modified stream into the coker furnace;

(d) heating the modified stream to a coking temperature in the coker furnace to produce a heated modified stream; and (e) transferring the heated modified stream from the coker furnace to a coke drum.

14. The method of claim 13 further comprising the step of adding at least a portion of at least one intermediate stream to the bottoms stream.

15. The method of claim 14 wherein the at least one intermediate stream is selected from the group consisting of a light coker gas oil stream, a heavy coker gas oil stream, and combinations thereof exiting the fractionator.

16. The method of claim 14 wherein at least a portion the at least one intermediate stream is hydrotreated.

17. A method for reducing furnace fouling in a delayed coking process for producing anode or fuel grade coke wherein at least one coker feed is supplied to a delayed coking unit comprised of a coker furnace, at least two coke drums and a coker fractionator comprising (a) supplying the feed to the coker furnace without first passing the feed through the fractionator, (b) increasing the aromaticity of the feed to produce a modified stream by combining with the feed upstream of the coker furnace a hydrotreated aromatic gas oil, wherein the hydrotreated aromatic gas oil is formed from an unhydrotreated aromatic gas oil in a hydrotreater wherein the hydrotreater has a hydrotreater product and a hydrotreater feed, and wherein the hydrotreated aromatic gas oil has an aromatic carbon content of at least about X % according to the formula $$X=(A\%)-[(0.02)\cdot(\text{hydrogen uptake in a hydrotreater})]$$

where X is as least about 20% as measured by 13C NMR based on the total carbon content of the hydrotreated aromatic gas oil and A is the aromaticity of a unhydrotreated aromatic gas oil as measured by 13C NMR and is at least about 40%, where hydrogen uptake is [ρ659.5·(Δ hydrogen content (wt %) of the hydrotreater product and the hydrotreater feed)] and where ρ is the density (grams/cc) of the hydrotreater feed;

(c) introducing the modified stream into the coker furnace;

(d) heating the modified stream to a coking temperature in the coker furnace to produce a heated modified stream; and (e) transferring the heated modified stream from the coker furnace to a coke drum.

18. The method of claim 17 further comprising the step of combining with the feed upstream of the coker furnace at least a portion of at least one intermediate stream exiting the fractionator.

19. The method of claim 18 wherein the at least one intermediate stream is selected from the group consisting of a light coker gas oil stream, a heavy coker gas oil stream, and combinations thereof exiting the fractionator.

20. The method of claim 18 wherein at least a portion the at least one intermediate stream is hydrotreated.

* * * * *